United States Patent [19]

Hiraoka et al.

[11] 4,353,680

[45] Oct. 12, 1982

[54] EXHAUST FAN WITH REMOVABLE FACE COVER

[75] Inventors: Shunji Hiraoka, Nagoya; Makoto Niwa, Aichi; Satoru Ishii, Chita, all of Japan

[73] Assignee: Tokyo Shibaura Denki Kabushiki Kaisha, Kawasaki, Japan

[21] Appl. No.: 152,981

[22] Filed: May 27, 1980

[30] Foreign Application Priority Data

Jun. 19, 1979 [JP] Japan ..... 54-83592[U]
Jun. 22, 1979 [JP] Japan ..... 54-86285[U]

[51] Int. Cl.[3] ..... F04D 29/52
[52] U.S. Cl. ..... 415/219 R; 415/201
[58] Field of Search ..... 415/9, 189, 190, 207, 415/219 R

[56] References Cited

FOREIGN PATENT DOCUMENTS

| | | | |
|---|---|---|---|
| 982531 | 1/1976 | Canada | 415/219 R |
| 1230640 | 9/1960 | France | 415/219 R |
| 1348335 | 11/1963 | France | 415/219 R |
| 765345 | 1/1957 | United Kingdom | 415/189 |
| 2054040 | 2/1981 | United Kingdom | 415/219 R |

*Primary Examiner*—Leonard E. Smith
*Attorney, Agent, or Firm*—Cushman, Darby & Cushman

[57] ABSTRACT

An exhaust fan with a motor for driving rotatable fan blades, a case for mounting and surrounding a motor supporting frame, and a face cover detachably mounted on the case, the cover and case having portions for engagement with each other for limiting movement of the cover to a predetermined distance by engaging each other when the cover becomes disengaged from the case.

15 Claims, 10 Drawing Figures

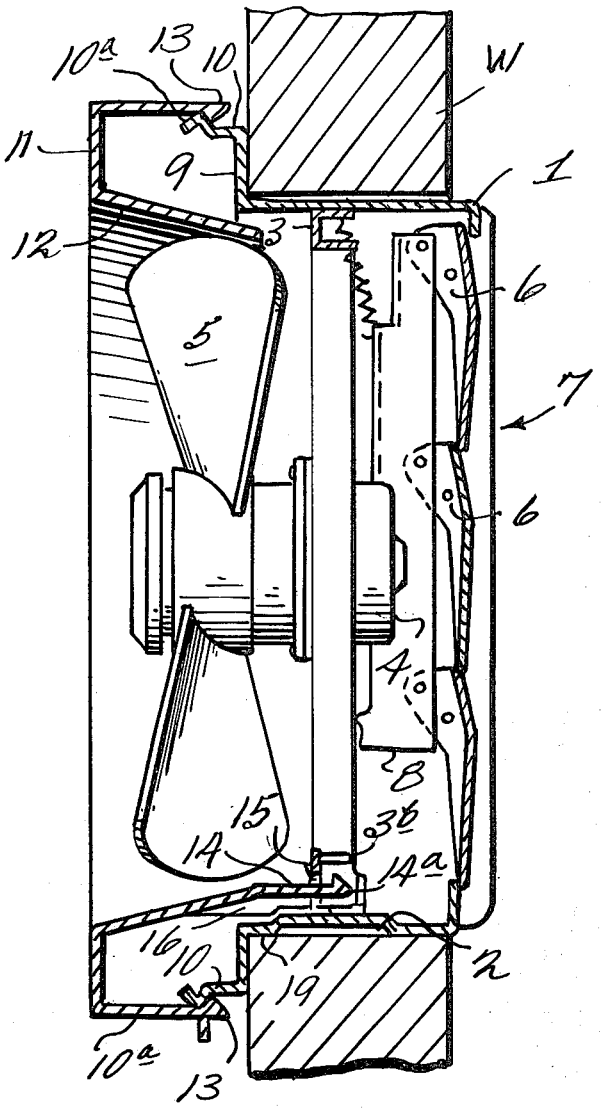
FIG. 1
FIG. 2
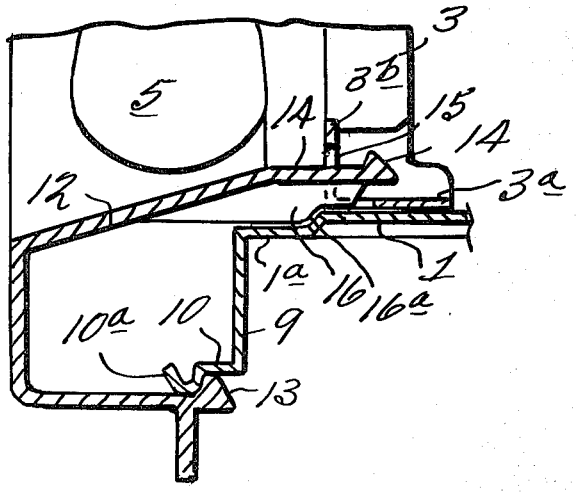

EXHAUST FAN WITH REMOVABLE FACE COVER

This invention relates to an exhaust fan and more particularly to an improvement in engaging means which are mounted on a case and a face cover for preventing the cover from falling from the case.

In an exhaust fan, for example, a ventilator for exhausting air from a kitchen, it is necessary to mount a face cover detachably on a case so that the cover can be cleaned. However, in prior exhaust fans another special connecting element is necessary to connect the cover with the case tightly to prevent the cover being loosened and falling off by the vibration of the drive or by wear of material. However, prior exhaust fans have the drawback that assembly is very difficult because the operator must connect the cover and the case by a specific connecting element whenever he wants to attach the cover to the case and the operator sometimes loses the connecting element because it is not integrally made with the case or the cover.

It is an object of this invention to provide an exhaust fan which is improved in attachment of the cover.

It is another object of this invention to provide an exhaust fan which can avoid the loosening or loosening and falling off of the cover without a special connecting element.

In this invention, a cover and a case are connected with each other by engaging means for limiting movement of the cover for example inclinational movement to a predetermined distance when the cover disengages from the case.

Other objects and features of the invention will become apparent to those skilled in the art as the disclosure is made in the following description of a preferred embodiment of the invention, as illustrated in an accompanying sheet of drawing in which:

FIG. 1 is a sectional view of an exhaust fan according to the first embodiment of this invention;

FIG. 2 is a partially enlarged sectional view according to the first embodiment of the invention;

Figure 3:
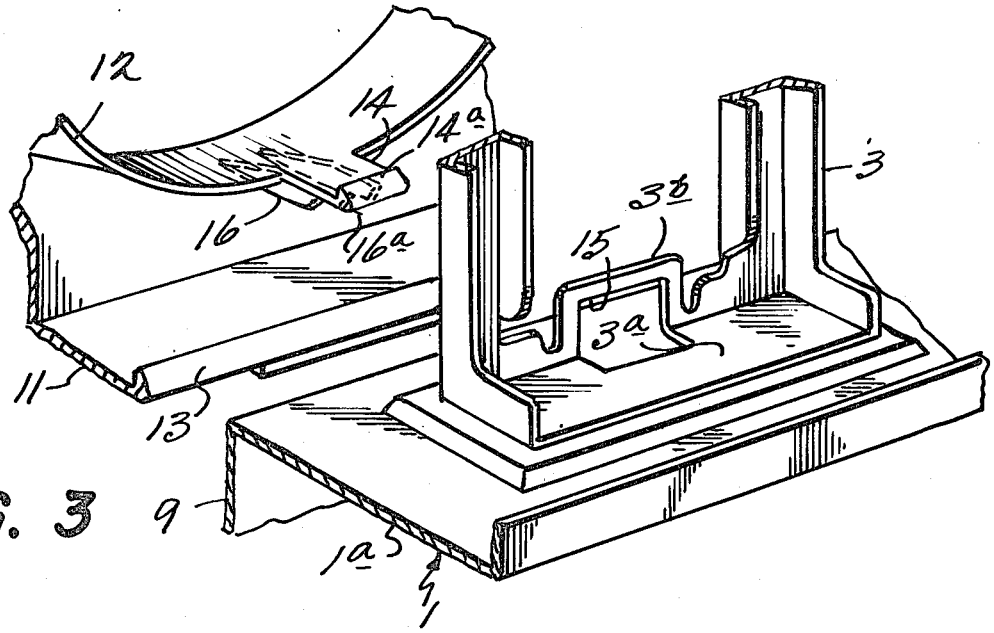
FIG. 3 is a partially enlarged perspective view according to the first embodiment of the invention.
Figure 4:
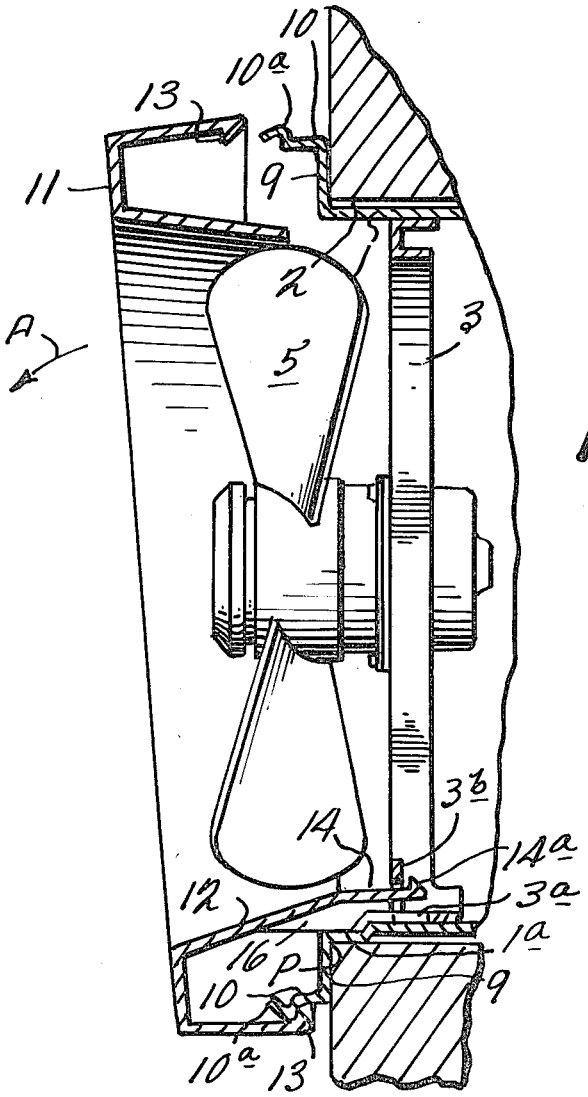
FIG. 4 is a sectional view to explain the engaging means according to the first embodiment of the invention.
Figure 5:
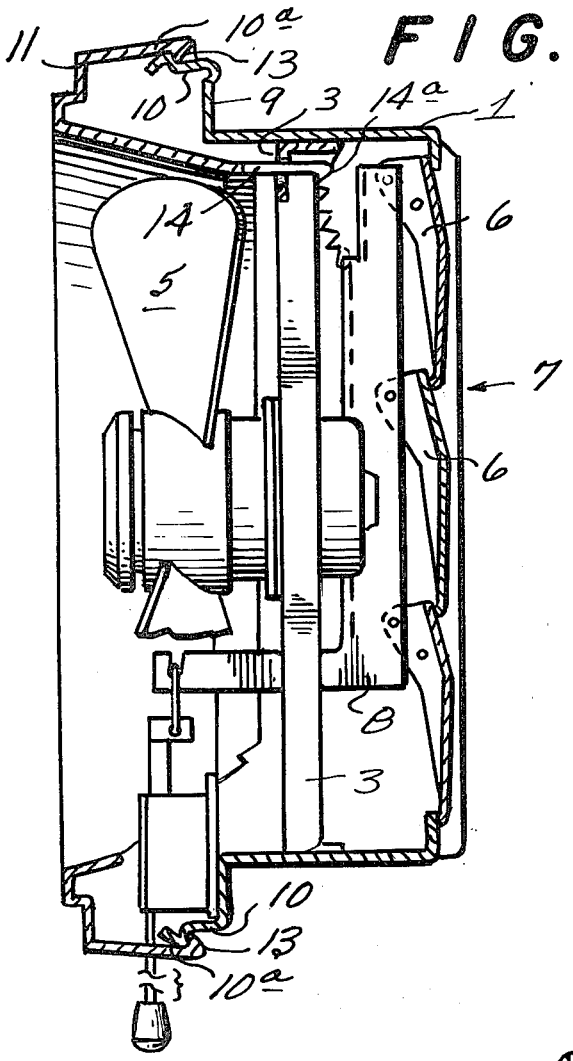
FIG. 5 is a sectional view according to the second embodiment of the invention.

Now, there will be described a first embodiment according to FIG. 1 to FIG. 4 which shows a ventilator for exhausting hot air from a kitchen.

A case 1 is formed to be mounted in an opening 2 of a wall W. A frame 3 for supporting a drive element, such as motor 4 is secured inside case 1. Fan blades 5 are rotatably mounted on a shaft (not shown) of motor 4. Three shutter blades 6 of a shutter 7 are located in the outer opening of case 1 and are movably mounted on a connecting lever 8. Connecting lever 8 moves up and down in response to off and on of the ON-OFF control switch of motor 4 respectively. Shutter 7 opens opening 2 of case 1 when connecting lever 8 is moved downwardly and closes opening 2 of case 1 when connecting lever 8 is moved upwardly. Four flanges 9 are formed on the peripheral edge portion of the inside opening of case 1 by bending substantially right angles thereof. Hooks 10 having a convex portion 10*a* are formed on the tips of top and bottom flanges 9 by bending substantially right angle thereof toward the inside of the room. A face cover 11 is formed integrally with a bellmouth 12 which is made of plastic material. Protrusions 13 are integrally formed on the tips of top and bottom of cover 11 therewith. Then, cover 11 is detachably secured to flange 9 of case 1 by elastically engaging convex portion 10*a* and protrusion 13. Fan blades 5 are surrounded by bellmouth 12 because bellmouth 12 extends into the inside opening of case 1 when cover 11 is engaged with case 1. Bellmouth 12 is formed in a substantially cylindrical shape which is tapered from the inside portion of the room to the outside portion thereof. A supporting projection 14 is integrally formed with the bottom portion of the outside opening of bellmouth 12 and has a horizontally extending tip. An upward hook 14*a* is integrally formed on the tip of supporting projection 14. An arm 3*b* is upwardly formed by bending a part of lower portion 3*a* of frame 3 and is secured to the inner surface of a bottom wall 1*a*. Hole 15 is surrounded by arm 3*b*. When cover 11 is engaged to case 1, hook 14*a* is located under the upper edge of hole 15 and behind arm 3*b*. Therefore, hook 14*a* does not engage with the upper edge of hole 15 when hook 14*a* passes through hole 15 (see FIG. 2). Projection 14 has to parallel ribs 16 on the undersurface thereof which act as a fulcrum under the bottom of bellmouth 12. The lower edge of rib 16 has a step 16*a* substantially coincident with the form of bottom wall 1*a* and has only a small clearance therewith, almost in contact with each other.

The operation of the invention will now be explained. The operator can take off cover 11 from case 1 to disengage hook 10 from protrusion 13 by pulling cover 11 to the inside of the room when he wants to clean the ventilator. After cleaning is finished, remounting is as follows. After putting the rear edge of rib 16 on bottom wall 1*a* of case 1 by pushing cover 11 inward, rib 16 slides on the surface of bottom wall 1*a*. The surface of bottom wall 1*a* guides supporting projection 14 into hole 15 and protrusion 13 is elastically engaged with convex portion 10*a* of hook 10 because supporting projection 14 is placed lower than the lower edge of arm 3*b* and just only passes through hole 15. Thus, cover 11 is attached to case 1.

If cover 11 is not sufficiently attached to case 1 or the engagement of cover 11 and case 1 become loose according to change of the materials thereof, or vibration of the drive, then, cover 11 inclines to the direction indicated by the arrow A for the point P as fulcrum because rib 16 of bellmouth 12 contacts with bottom wall 1*a* of case 1. The movement of cover 11 causes the engagement of supporting projection 14 and arm 3*b* and cover 11 is held to case 1 by supporting projection 14 (see FIG. 4).

The fall of cover 11 can avoid the engagement of top hook 10 and top protrusion 13 if the engagement of bottom hook 10 and bottom protrusion 13 comes off. In the foregoing embodiment, cover 11 is easily able to move because rib 16 covers the clearance between bellmouth 12 and the surface of bottom wall 1*a*.

FIG. 5 to FIG. 8 show the second embodiment of the invention. In this embodiment, an arm is mounted on the inner surface of a top wall 1*b* and has a groove 17 which is continuously formed with hole 15, and the end portion of supporting projection 14 is separated so that hook 14*a* is also separated by portions 18. The width of groove 17 is narrower than the width of hole 15 and the width of portions 18 of supporting projection 14 is formed between the width of hole 15 and groove 17. Length B of supporting projection, which projects to behind frame 3, is longer than width C of convex portion 10*a* of hook 10. As cover 11 is attached to case 1, a clearance D between the edge of supporting projection 14 and the bottom of groove 17 is smaller than a clearance E between bellmouth 12 and fan blade 5. According to above-mentioned second embodiment, cover 11 does not fall even if the engagement of top hook 10 and top protrusion 13 comes off because portions 18 get into groove 17 before cover 11 falls and engage with the arm as length B is larger than width C. Bellmouth 12 of cover 11 does not contact with fan blades 5 because clearance D is smaller than clearance E. Supporting projection 14 is certainly passed through hole 15 because portions 18 of supporting projection 14 are elastically deformable.

Figure 10:
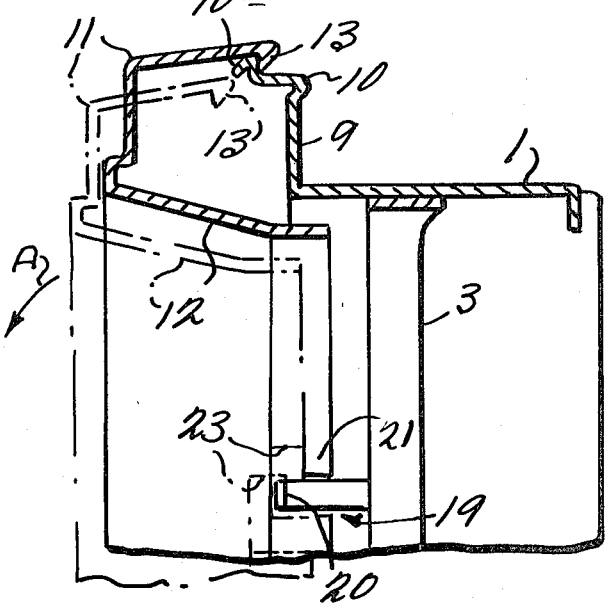
FIG. 10 is a partially enlarged view to explain the engaging means according to the third embodiment of the invention.
Figure 6:
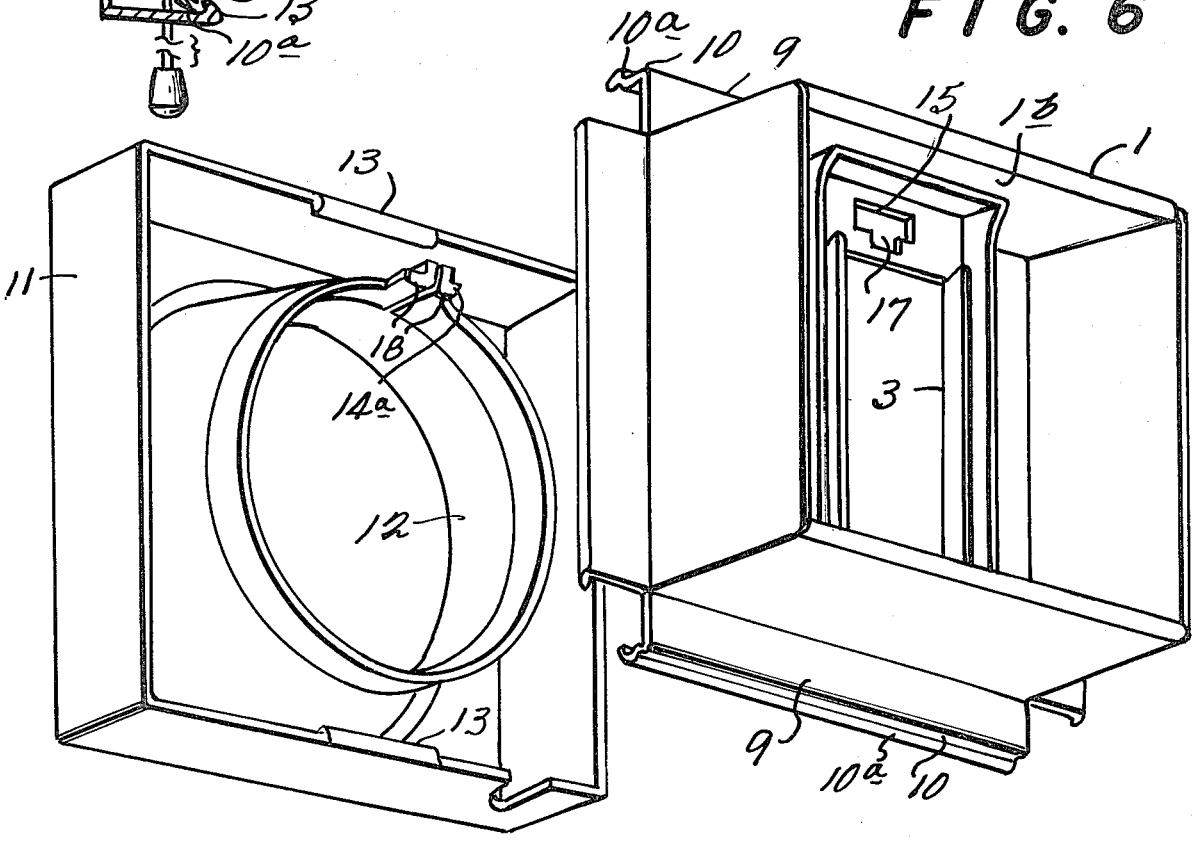
FIG. 6 is an exploded view according to the second embodiment of the invention.
Figure 7:
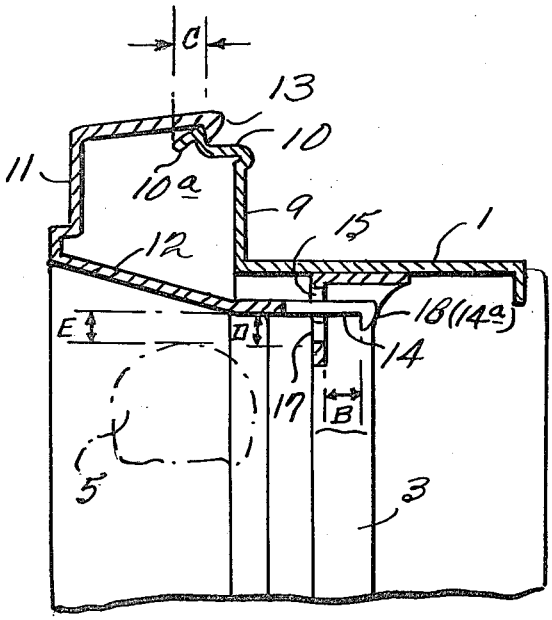
FIGS. 7 and 8 are partially enlarged sectional views to explain the engaging means according to the second embodiment of the invention.
Figure 8:
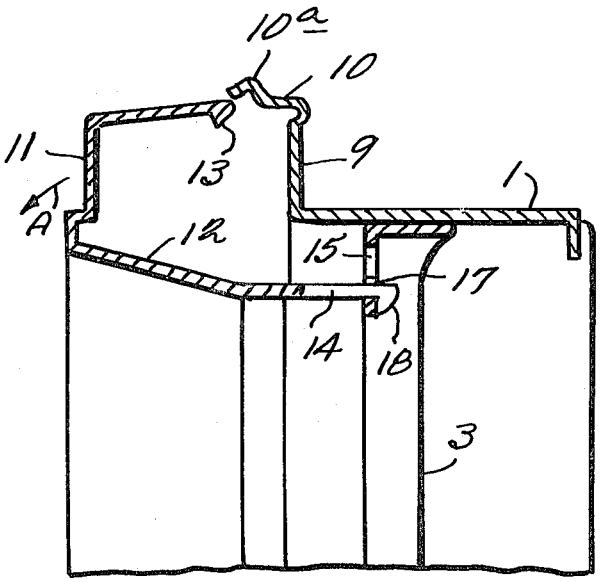
Figure 9:
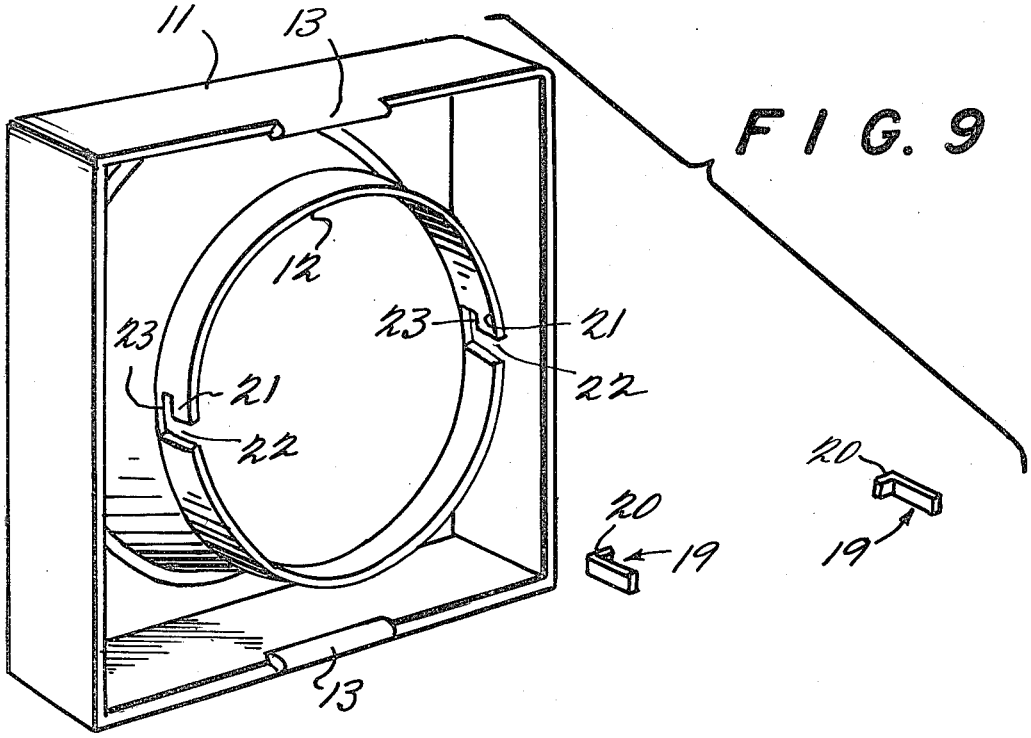
FIG. 9 is a perspective view of bellmouth and a supporting projection according to the third embodiment of the invention.

FIG. 9 and FIG. 10 show the third embodiment of the invention. In this embodiment, a pair of supporting projections 19 which each have a hook 20 are secured to frame 3 and arm 21 is secured to bellmouth 12 and is notched for permitting the passage of supporting projection 19 to hole 22 and groove 23. Cover 11 does not fall even if the engagement of the top hook 10 and protrusion 13 comes off because hook 20 of supporting projections 19 get into groove 23 through the notch of arm 21 and hole 22 before cover 11 falls and engage with arm 21.

This invention is not restricted to the above-mentioned embodiment. Many changes and modifications from the above embodiment can be carried out without departing from the scope of the invention, that scope being defined only by the scope of the appended claims.

What is claimed is:

1. An exhaust fan comprising:

rotatable fan blades;

drive means for rotating said rotatable fan blades;

a frame for supporting said drive means;

a case for mounting and surrounding at least said frame;

a face cover detachably mounted on said case and including a bellmouth for surrounding said rotatable fan blades;

engaging means mounted on said cover and said case for engagement with each other for limiting of movement of said cover to a predetermined distance.

2. The exhaust fan as in claim 1, wherein said cover is mounted for movement with the lower portion thereof as a fulcrum.

3. The exhaust fan as in claim 2, wherein said engaging means includes a supporting projection which is mounted on one of said cover or said case and a arm which is mounted on the other thereof having a hole for permitting the insertion of said supporting projection and for preventing said cover from movement thereof by the engagement of said supporting projection and said arm.

4. The exhaust fan as in claim 3, wherein said arm is integrally molded with said bellmouth and said supporting projection is mounted on said case.

5. The exhaust fan as in claim 3, wherein said arm is integrally molded with said bellmouth and said supporting projection is mounted on said frame.

6. The exhaust fan as in claim 3 further includes a fulcrum projection for inclining said cover.

7. The exhaust fan as in claim 6, wherein said fulcrum projection contacts the inner surface of the bottom wall of said case in case of disengagement of said case and cover.

8. The exhaust fan as in claim 7, wherein said fulcrum projection includes a rib extending to the set-reset direction of said cover for guiding said cover the inner surface of the bottom wall of said case.

9. The exhaust fan as in claim 3, wherein said supporting projection is integrally molded with said bellmouth.

10. The exhaust fan as in claim 3 or 9, wherein said supporting projection further includes a hook formed on the tip thereof for engaging with said arm.

11. The exhaust fan as in claim 10, wherein said arm is mounted on the inner surface of the bottom wall of said case.

12. The exhaust fan as in claim 11, wherein said arm is integrally molded with said frame.

13. The exhaust fan as in claim 10, wherein said arm is supported on the inner surface of the top wall of said case.

14. The exhaust fan as in claim 13, wherein said arm includes a groove which is continuously formed with said hole having a width narrower than the width of said hole and a width of said supporting projection is formed between the width of said hole and said groove.

15. The exhaust fan as in claim 13, wherein said arm is integrally molded with said frame.

* * * * *